United States Patent [19]

Stahl

[11] 3,963,062

[45] June 15, 1976

[54] CATALYST CHANGER FOR UNDERFLOOR TYPE CATALYTIC CONVERTER

[75] Inventor: John F. Stahl, Exton, Pa.

[73] Assignee: Oxy-Catalyst, Incorporated, West Chester, Pa.

[22] Filed: Aug. 16, 1974

[21] Appl. No.: 497,946

[52] U.S. Cl. ..... 141/67; 23/288 F; 141/378; 259/DIG. 42; 285/9 R

[51] Int. Cl.[2] ..... B65B 1/08

[58] Field of Search ..... 55/309; 302/51; 141/340, 387, 1, 5, 8, 11, 12, 65–69, 71–81, 84, 93, 98, 270, 324, 363, 364, 369, 375, 378; 23/288 F; 222/193; 259/72, DIG. 42; 285/9 R

[56] References Cited

UNITED STATES PATENTS

| | | | |
|---|---|---|---|
| 3,190,320 | 6/1965 | Burgess et al. | 141/72 |
| 3,295,565 | 1/1967 | Grandy | 141/77 |
| 3,865,159 | 2/1975 | Mayfield | 141/67 |

*Primary Examiner*—Houston S. Bell, Jr.
*Attorney, Agent, or Firm*—Paul & Paul

[57] ABSTRACT

An improved device for removing and replacing catalyst particles or pellets in an underfloor type catalytic converter is provided. The catalytic converter is a purifier installed in the exhaust pipe of an internal combustion engine for the purpose of purifying the emissions thereof. The catalyst changer includes a canister for containing catalyst particles, a conduit for conducting particles from the converter to the canister and vice versa, an eccentrically mounted vibrator to aid in removing particles from the converter and in replenishing the converter with a fresh supply of particles tightly packed in a catalytic bed, and clamping means for rigidly clamping the changer to the catalytic converter during removal and replacement of the catalytic particles. The clamping means is of a construction and magnitude to cause opposed clamping elements to deform the outer skin or surface of the casing of the coverter. Such clamping arrangement aids in transmitting the full effect of the vibrational forces created by the vibrator to the catalytic bed of the converter, during replacement of the catalytic particles.

8 Claims, 6 Drawing Figures

CATALYST CHANGER FOR UNDERFLOOR TYPE CATALYTIC CONVERTER

SUMMARY OF THE INVENTION

The primary object of this invention is to provide a new and improved catalyst changer for underfloor type catalytic converters for internal combustion engines to be utilized in a catalyst changing system of the type illustrated and described in Harold R. Smithson and John F. Stahl pending U.S. patent application Ser. No. 468,746, filed May 10, 1974, entitled "Catalyst Changing System." The catalyst changer of this invention is a device for removing spent catalyst particles from a purifier installed in the exhaust pipe of an internal combustion engine and replacing them with a fresh supply of particles. It comprises a main frame which supports means for clamping the changer rigidly to the converter during removal and replacement of catalyst particles, a canister for collecting used particles removed from the converter and for providing a fresh supply to be delivered to the converter, a conduit for transmitting catalyst particles between the converter and the canister and a vibrator for imparting vibratory forces to the converter during the process of removing and replacing its supply of catalyst particles.

A further object of the invention is to provide such a catalyst changer wherein the vibrator is mounted eccentrically of the main frame and conduit, and is provided with an unbalanced weighted rotor, to impart to the converter, during the removal and replenishment of catalyst particles, a jarring, multi-directional, vibrational effect. The severe complex vibrations aid in ensuring that all of the used catalyst particles are removed from the converter, and that the converter is fully replenished with a fresh supply of tightly packed particles.

A further object is to provide a new and improved clamping means for securing the catalyst changer to the catalytic converter rigidly and unmovably during the course of removing and replenishing its supply of catalyst particles. The novel clamping means comprises opposing clamping elements adapted to engage the converter on opposite surfaces, and to clamp or squeeze the converter casing with sufficient force and rigidity so as to transmit to the bed of catalyst particles therein the full effect of the complex, multi-directional, jarring, vibrational forces generated by the vibrator. The opposing clamping elements are applied to opposite sides of the converter casing in such a way, and with such force, as to actually penetrate the surface planes of the casing to which the clamping elements are applied. In the preferred form, one clamping element is provided with gripping means, which is applied to the casing with such clamping force as to form indentations therein. The other clamping element may be a tapered or frusto-conical element adapted for limited penetration of the fill hole of the converter, to provide the opposing clamping force. As a result of the deformation of the converter casing by the first mentioned clamping element, and the penetration of the second clamping element into the fill hole, the catalyst changer is rigidly and unmovably clamped to the converter during the particle changing process.

THE DRAWING

DETAILED DESCRIPTION OF THE PREFERRED EMBODIMENT OF THE INVENTION

Figure 1:
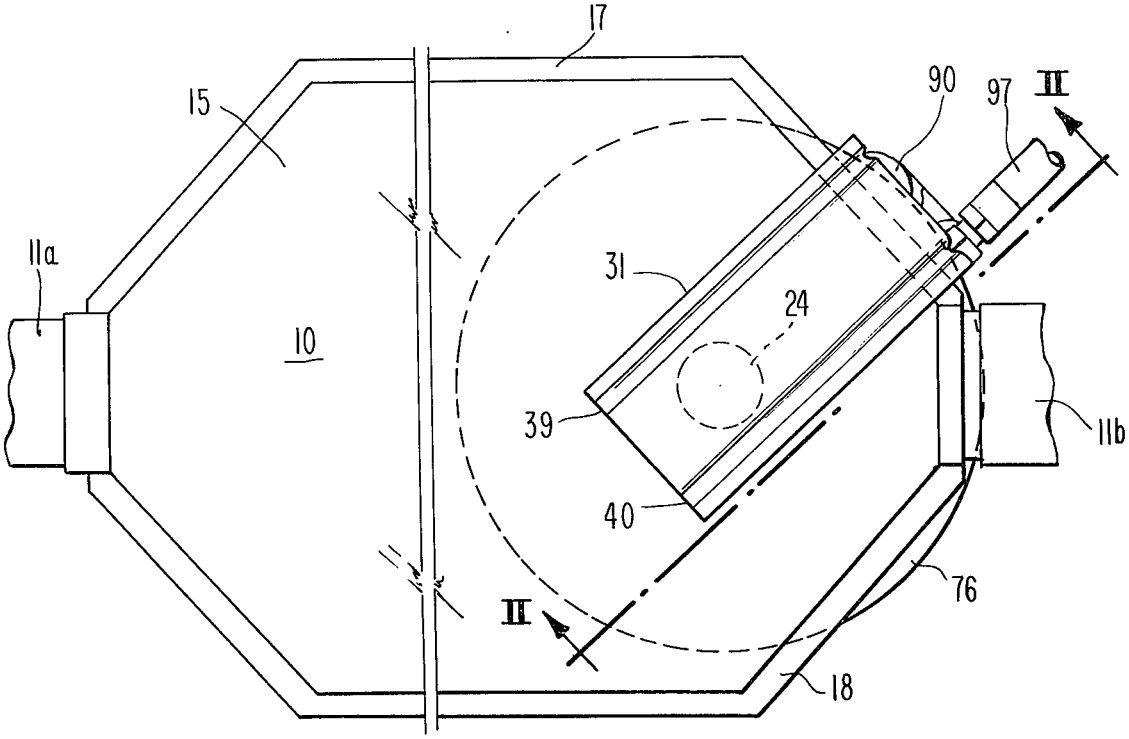
FIG. 1 is a fragmentary view in top plan illustrating a preferred form of the catalyst changer of this invention clamped to an underfloor type catalytic converter.
Figure 2:
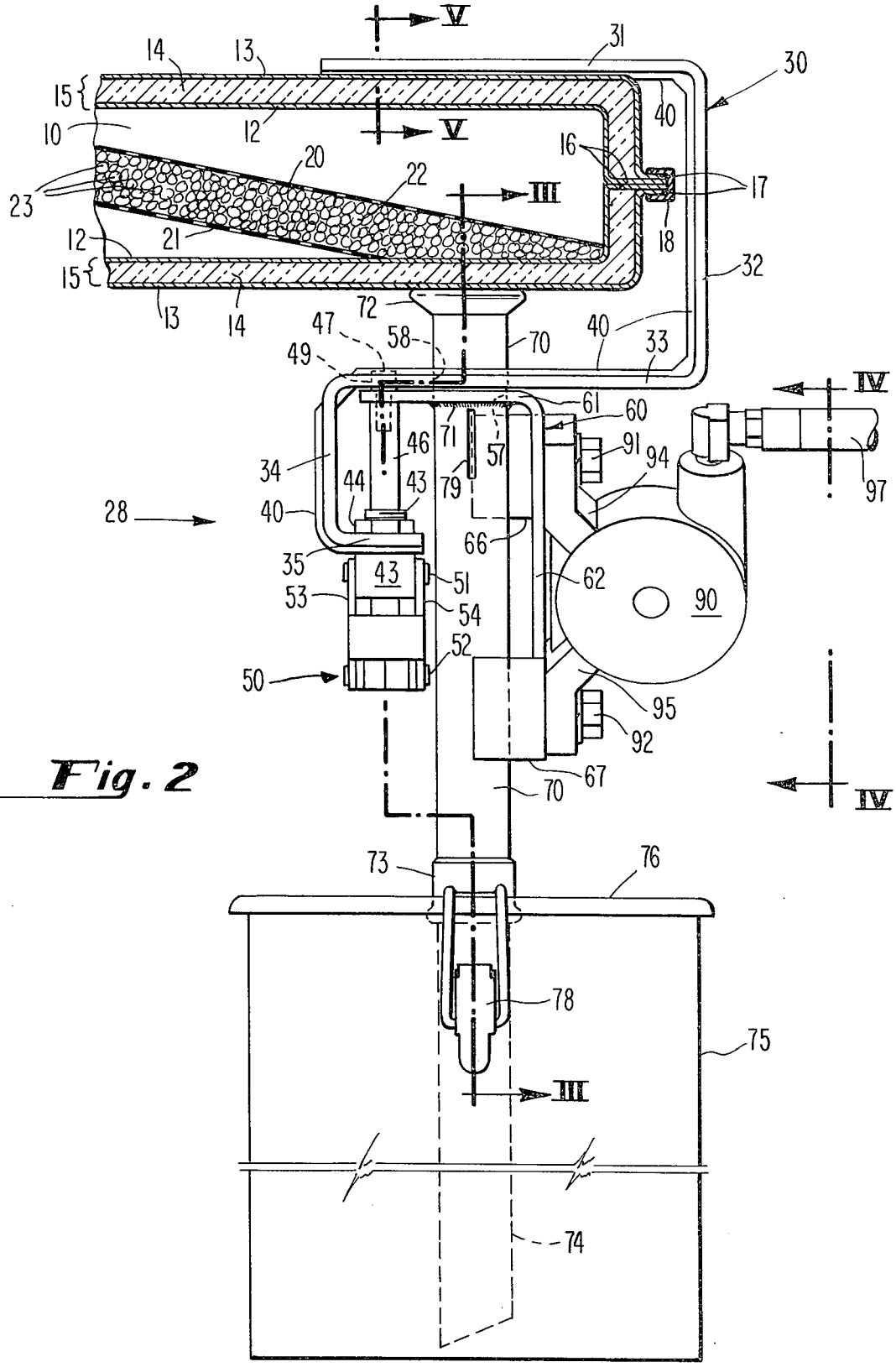
FIG. 2 is a fragmentary view in section taken as indicated by the lines II—II in FIG. 1.

In FIGS. 1 and 2 there is shown a conventional catalytic converter or exhaust purifier 10 installed in the exhaust pipe 11a, 11b of an internal combustion engine (not shown) for the purpose of purifying the exhaust emissions thereof. The converter 10 includes inner and outer spaced walls 12 and 13 (FIG. 2) having any suitable heat insulating material 14 disposed therebetween, to provide a hollow casing or shell 15. Preferably, the inner and outer walls 12, 13 of the converter 10 each are formed of separate upper and lower mating sections or halves, the respective opposing edges of which are provided with outwardly extending, lateral flanges 16, 17 extending in contiguous, overlapping relation about the exterior of the converter 10, except where interrupted by the exhaust pipe. The contiguous flanges 16, 17 are crimped or secured by means of a channel-shaped seal 18 extending around the perimeter of the converter 10, to render the casing 15 air-tight.

The converter 10 is provided internally with the usual inclined, uniformly spaced, perforated grids 20, 21 defining an inclined catalytic bed 22 of catalyst particles 23. The lower portion of the catalytic bed 22 is in communication with a fill hole or port 24, by means of which catalyst particles 23 may be removed from the converter, and replaced with a fresh supply of particles. The fill hole 24 includes a fitting 25 (FIG. 3) secured in any suitable manner within the casing 15. Fitting 25 is provided with an internally threaded bore 26 for reception of a suitable threaded plug (not shown) to close the fill hole 24.

Figure 5:
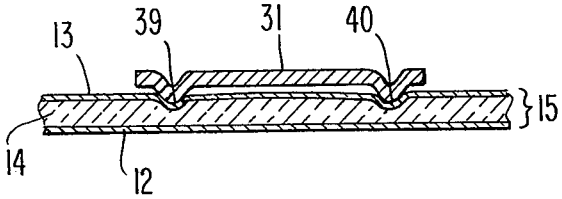
FIG. 5 is a fragmentary view in section taken as indicated by the lines V—V in FIG. 2.

The novel catalyst changer 28 of this invention includes an integral, serpentine shaped main frame 30 (FIG. 2). Frame 30 includes three spaced, horizontal components 31, 33, 35. Frame components 31 and 33 are connected, through suitable right angle bends, by a vertical frame component 32, and frame components 33 and 35 are connected, through similar right angle bends, by a second vertical frame component 34. The upper horizontal frame component 31, as will be presently explained, serves as one element of the novel clamping means of the catalyst changer of this invention. As best shown in FIG. 5, frame component 31 is provided with a pair of uniformly spaced, longitudinally extending, downwardly protruding ribs or beads 39, 40. If desired, the ribs 39, 40 may extend continuously throughout the length of the main frame 30 (FIGS. 2, 3).

The lower horizontal frame component 35 is provided with an aperture 42 (FIG. 3) for the reception of a vertical tubular sleeve 43. The upper end of sleeve 43 is threaded externally for the reception of an internally threaded nut 44 to secure the sleeve firmly within the aperture 42. Disposed within the bore of sleeve 43, with capacity for slidable vertical movement therein, is a tubular element 46, the upper end of which is threaded internally for the reception of a threaded bolt 47.

Tubular element 46 is advanced or retracted vertically relative to sleeve 43 by means of a toggle clamp 50. The lower end of sleeve 43 is provided with spaced vertical slots for the reception of a horizontal pin 51 secured within the tubular element 46. Toggle clamp 50 is provided with a horizontal pin 52, which is parallel to pin 51 and spaced below tubular element 46. A pair of spaced, vertical links 53, 54 connect pin 51 of the tubular element 46 to pin 52 of the toggle clamp 50. By means of links 53, 54, tubular element 46 may be advanced or retracted vertically, relative to sleeve 43 and the main frame 30, by toggle clamp 50.

Figure 3:
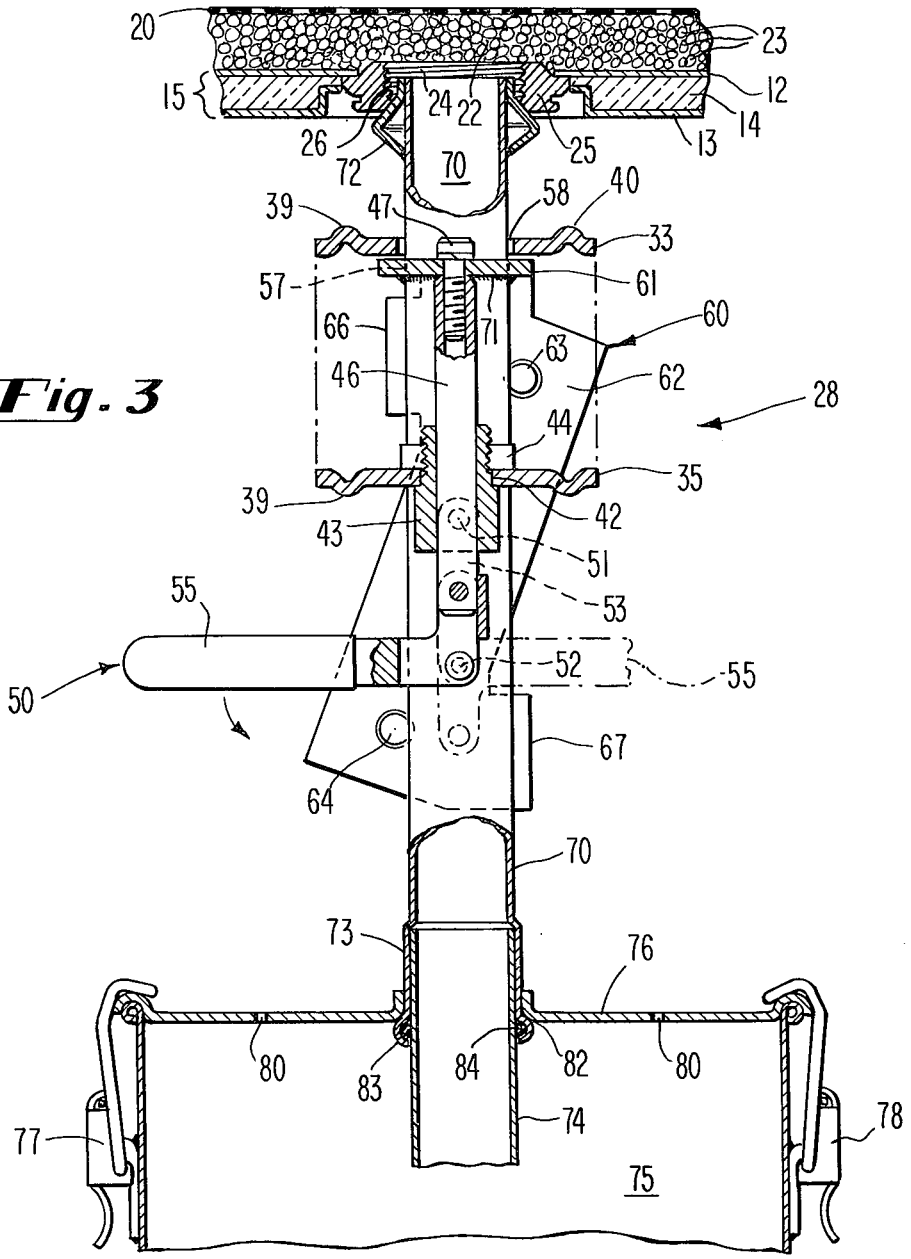
FIG. 3 is a fragmentary view in section taken as indicated by the lines III—III in FIG. 2.

FIGS. 2 and 3 illustrate toggle clamp 50 in clamping position, with tubular element 46 in its advanced, vertical position. An aperture 49 in frame component 33 provides clearance for the head of bolt 47. When the handle 55 of toggle clamp 50 is retracted to its shadow position shown in FIG. 3, tubular element 46 moves downward to its retracted position.

Secured to the upper end of tubular element 46, by bolt 47, is the upper horizontal element 61 of a support 60. A vertical tubular conduit 70 is snugly engaged within an aperture 57 in element 61, and is welded or otherwise affixed at 71 to the element 61. The upper end of conduit 70 passes freely through an aperture 58 in frame component 33. Conduit 70 is axially aligned with fill hole 24 and is utilized for the purpose of transferring catalyst particles from and to the catalytic bed 22, when desired or required.

When toggle clamp 50 is moved to clamping position, as shown in FIG. 3, it raises tubular element 46, as previously explained, to thereby raise support 60 and tubular conduit 70, to advance the upper end of the conduit into fitting 25. The external diameter of conduit 70 is smaller than the internal diameter of the bore 26 of fitting 25, to facilitate such penetration.

Securely fixed externally of the upper end of conduit 70 is an annular clamping element 72 of bowed, skirted or frusto-conical construction. The outermost diameter of clamping element 72 is greater than the diameter of threaded bore 26, and thereby limits the extent to which the upper end of conduit 70 penetrates fitting 25 when toggle 50 is in clamping position. As is best illustrated in FIG. 2, when the toggle 50 is in clamping position, the catalyst changer 28 is clamped securely to the catalytic converter 10, with the horizontal frame component 31 and the annular bowed element 72 at the top of conduit 70 serving as the opposing clamping elements.

The force of the clamping effect of frame component 31 and element 72 is determined by the design and dimensions of elements 46 and 72, and the extent to which conduit 70 is caused to advance toward the fitting 25 by the clamping action of toggle 50. The squeezing or clamping action of the opposing clamping elements 31, 72 is of such magnitude as to cause the ribs 39, 40 of frame component 31 to deform and thus grip the upper surface of the outer wall 13 of the casing 15, as illustrated in FIG. 5. The formation of such indentations in the casing 15 by the ribs or gripping means 39, 40 is an important characteristic of this invention, since it helps ensure rigid clamping of the catalyst changer 28 to the converter 10 during replacement of the catalytic particles in the bed 22.

Thus, the opposing clamping elements 31, 72 are designed, and operative during clamping, to penetrate the planes of the outer skin or surfaces of the top and bottom of the casing 15. Such penetration provides a secure and unmovable clamping effect, when the toggle clamp 50 is in clamping position.

The lower end of conduit 70 is enlarged at 73 for the telescopic reception of a lower tubular conduit 74, which extends into a canister 75. The canister receives catalytic particles 23 removed from converter 10, and may provide a source of supply of fresh particles for the converter. The arrangement and operation of conduits 70 and 74 and canister 75 is similar to that illustrated and described in Harold R. Smithson pending U.S. patent application Ser. No. 404,304, filed Oct. 9, 1973, entitled "Adaptor for Emptying and Refilling Container."

Canister 75 is provided with a lid 76 secured in place by clamps 77, 78. Lid 76 has one or more air ports 80, and has a centrally disposed aperture 82 for the snug reception of the lower, enlarged portion 73 of conduit 70.

Formed at the lower end of the enlarged tubular portion 73 is an annular rib or shoulder 83, the outermost diameter of which is larger than the internal diameter of aperture 82. The snug fit of enlarged tubular portion 73 within aperture 82 together with the annular shoulder 83 ensures the retention of canister 75 on the lower end 73 of conduit 70. Thus, the canister at all times will move with the conduit 70, when the latter is advanced to and retracted from the fill hole 24 by toggle clamp 50.

An O-ring disposed between the inner surface of shoulder 83 and the outer surface of lower conduit 74 ensures the tight retention of conduit 74 telescopically within the enlarged portion 73 of conduit 70. If desired, conduit 70 may be provided with an elongated slot 79, or other suitable means, to provide a sight opening and a pneumatic vent.

The support 60 includes a vertical base portion 62 depending from one end of the horizontal support element 61. Support 60 is provided with right-angled extensions 66, 67 disposed on opposite sides of its base portion 62. The inner surfaces of the extensions 66, 67 are spaced horizontally a distance approximately equal to the outside diameter of tube 70. By reason of the weld 71 and extensions 66, 67, support 60 is rigidly affixed to the vertical tubular conduit 70. The arrangement ensures that, when toggle 50 is moved to clamping position, to raise tubular element 46 and support 60, conduit 70 is advanced to the catalytic converter 10 for the consequent clamping engagement of element 72 within the fitting 25 in the bottom of casing 15.

Figure 4:
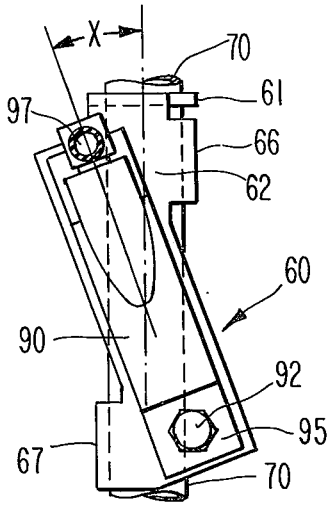
FIG. 4 is a fragmentary view in section taken as indicated by the lines IV—IV in FIG. 2.

As illustrated in FIG. 3, the dependent base portion 62 of support 60 is provided with two spaced, obliquely arranged, internally threaded apertures 63, 64. The two apertures 63, 64 are aligned on the base 62 at an angle $x$ (FIG. 4) to the vertical axes of the support 60 and the tubular conduit 70. Preferably, angle $x$ is on the order of 20°.

Figure 6:
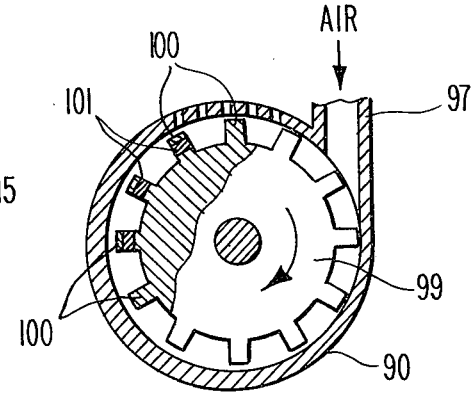
FIG. 6 is a fragmentary view in section of the vibrator used in the preferred embodiment of the invention.

A vibrator 90 is affixed to the outside of the base 62 by threaded bolts 91, 92 passing through supports 94, 95 and engaging the internally threaded apertures 63, 64. Any conventional type of vibrator may be used, such as, for example, a pneumatic motor connected to a high pressure air line 97, and having a rotatable rotor element 99 (FIG. 6) having a plurality of radial veins or fins 100, several of which are provided with weighted elements 101, such as lead-filled bores. It is clear from the geometry shown, in FIG. 4, that the axis of rotation of the rotor element 99 is at the angle ($x$) with respect to the horizontal. Stated otherwise, such axis is at the angle ($x$) to a line perpendicular to the vertical longitudinal axis of the tubular conduit 70.

Due to its angular mounting on the support 60 and the unbalanced weighted effect of its vanes 100, vibrator 91 imparts a substantial, multi-directional vibratory effect to the catalyst changer 28. By reason of the rigid clamping effect of the opposed clamping elements 31, 72, and the secure mounting of support 60 on conduit 70, the jarring, multi-directional vibrational forces produced by the vibrator are transmitted to the catalyst particles 23 in the catalytic bed 22 of the converter 10. Such vibrational effect aids substantially in removing catalyst particles from bed 22, and in replenishing bed 22 with a fresh supply of tightly packed particles.

As will be readily understood, the catalyst changer 28 of this invention may be readily adapted for use in the novel catalyst changing system illustrated and described in Harold R. Smithson and John F. Stahl pending U.S. patent application Ser. No. 468,746, filed May 10, 1974, entitled "Catalyst Changing System." Of course, the catalyst changer of this invention also may be employed with any suitable system, adapted to be connected to an internal combustion engine, for the removal and replacement of spent catalytic particles of a catalytic converter or exhaust purifier of the type illustrated by converter 10 herein.

Although a preferred embodiment of this invention has been shown and described in detail herein for the purpose of illustration, it is to be understood that various changes and modifications may be made in the materials, structure and arrangement of the parts without departing from the principal or utility of the invention, or the scope thereof as set forth in the appended claims.

I claim:

1. A catalyst changer for a catalytic converter having a casing, a supply of catalytic material within the casing and a fill hole in the casing in communication with the supply of catalyst material, said changer including:

a. a vertical conduit for conducting catalyst material from and to the converter, the top portion of said conduit being engageable in said fill hole and having adjacent to the top thereof a fitting adapted for engagement with said fill hole, b. a frame for supporting said conduit from said converter, said frame including means for engaging the top of said converter and also including a portion disposed below and spaced from said converter, means engageable with said conduit for advancing said conduit toward and retracting it from said fill hole and for squeezing and rigidly clamping said casing between said top engaging means and said conical fitting when said top portion of said conduit is engaged with said fill hole with said conduit disposed in fully advanced position, and c. a vibrator securely mounted on said conduit for imparting vibrations thereto and through said conduit to said converter during removal and replacement of its supply of catalyst material.

2. The catalyst changer of claim 1, wherein said vibrator is mounted eccentrically of the longitudinal axis of said conduit.

3. The catalyst changer of claim 1, wherein the underside of said top engaging component is provided with gripping means adapted to deform said casing surface during clamping.

4. The catalyst changer of claim 1, further including a canister secured to the lower end of said conduit and intercommunicating therewith.

5. The catalyst changer of claim 2, wherein said vibrator has a rotatable element and is mounted such that the axis of rotation of said element is disposed obliquely to the longitudinal axis of said conduit.

6. The catalyst changer of claim 1, wherein said means for squeezing and clamping said casing includes a toggle operative to advance said conduit toward said casing and to cause rigid clamping of said catalyst changer to said casing.

7. The catalyst changer of claim 1, wherein the wall of said conduit has a longitudinal slot for providing a sight opening and a pneumatic vent.

8. The catalyst changer of claim 5, wherein the angle of obliquity of the axis of rotation of said vibrator element is of the order of 20° to the horizontal.

* * * * *